US006240584B1

(12) United States Patent
Perez et al.

(10) Patent No.: US 6,240,584 B1
(45) Date of Patent: Jun. 5, 2001

(54) MATTRESS ASSEMBLY

(75) Inventors: Timothy W. Perez, James Island; Sohrab Soltani, Charleston; James J. Romano, James Island, all of SC (US)

(73) Assignee: Hill-Rom, Inc., Batesville, IN (US)

( * ) Notice: Subject to any disclaimer, the term of this patent is extended or adjusted under 35 U.S.C. 154(b) by 0 days.

(21) Appl. No.: 09/479,353

(22) Filed: Jan. 7, 2000

Related U.S. Application Data

(60) Provisional application No. 60/115,116, filed on Jan. 8, 1999.

(51) Int. Cl.[7] ..... A47C 27/08

(52) U.S. Cl. ..... 5/713; 5/710; 5/714; 5/732

(58) Field of Search ..... 5/713, 710, 711, 5/714, 732

(56) References Cited

U.S. PATENT DOCUMENTS

| | | | |
|---|---|---|---|
| 1,730,752 | 10/1929 | Withers . | |
| 2,604,641 | 7/1952 | Reed . | |
| 3,772,717 | 11/1973 | Yuen et al. . | |
| 3,978,530 | 9/1976 | Amarantos . | |
| 4,042,988 | 8/1977 | Holliday . | |
| 4,525,885 | 7/1985 | Hunt et al. . | |
| 4,541,135 | 9/1985 | Karpov . | |
| 4,644,597 | 2/1987 | Walker . | |
| 4,788,729 | 12/1988 | Walker . | |
| 4,803,744 | 2/1989 | Peck et al. . | |
| 4,944,060 | 7/1990 | Peery et al. | 5/713 |
| 5,022,110 | 6/1991 | Stroh . | |
| 5,067,189 | 11/1991 | Weedling et al. | 5/81.1 R |
| 5,367,728 | 11/1994 | Chang . | |
| 5,483,709 | 1/1996 | Foster et al. . | |
| 5,539,942 | 7/1996 | Melou . | |
| 5,561,873 | 10/1996 | Weedling | 5/711 |
| 5,564,142 | 10/1996 | Liu | 5/710 |
| 5,634,225 | 6/1997 | Miller, Sr. et al. | 5/710 |
| 5,655,239 | 8/1997 | Caparon et al. | 5/713 |
| 5,701,622 | 12/1997 | Biggie et al. | 5/713 |
| 5,729,853 | 3/1998 | Thompson | 5/713 |
| 5,794,288 | 8/1998 | Soltani et al. | 5/713 |
| 6,085,372 * | 7/2000 | James et al. | 5/713 |

FOREIGN PATENT DOCUMENTS

| | | |
|---|---|---|
| 295 21 505 U | 1/1998 | (DE) . |
| 297 17 204 U | 12/1998 | (DE) . |
| 2 092 439 | 8/1982 | (GB) . |
| 2 267 217 | 12/1993 | (GB) . |

* cited by examiner

*Primary Examiner*—Alexander Grosz
(74) *Attorney, Agent, or Firm*—Bose McKinney & Evans LLP

(57) ABSTRACT

A mattress assembly comprises an inflatable central support portion having a head end, a foot end, a first side and a second side, and first and second side bolsters coupled to the first and second sides, respectively, of the inflatable central support portion. The first and second side bolsters each have at least two chambers extending along a longitudinal axis of the first and second side bolsters. At least one of the chambers is a manifold in fluid communication with the central support portion. The manifold is configured to be coupled to an air supply to supply air to the central support portion and the other chambers.

17 Claims, 6 Drawing Sheets

MATTRESS ASSEMBLY

This application claims the benefit of U.S. provisional application Ser. No. 60/115,116 filed Jan. 8, 1999.

BACKGROUND SUMMARY OF THE INVENTION

The present invention relates to a mattress, a mattress overlay, or a mattress replacement assembly including an air cushion having air zones for supporting a person, and to a pressure control assembly for controlling the pressure of pressurized fluid contained by the air zones of the air cushion.

Some mattresses, mattress overlays, or mattress replacement systems (hereinafter mattresses) are provided with air sacks to support a person and to provide adjustable firmness characteristics. These air mattresses include one, or several air sacks that are inflated to different pressures to adjust the firmness in selective regions or zones of the mattress. One such mattress is illustrated in U.S. Pat. No. 5,794,288, entitled PRESSURE CONTROL ASSEMBLY FOR AN AIR MATTRESS, which is herein incorporated by reference.

It is desirable for an air mattress to provide different pressure zones of support for a person on the mattress while maintaining sufficient pressure along opposite side edges of the mattress to provide support when the person sits or rests along one of the side edges. In the illustrated embodiment, each air zone is in fluid communication with a manifold having an interior region that is maintained at a constant pressure. The constant pressure of the pressurizing fluid within the manifold may be the same as or may be different from the pressure of pressurized fluid within at least one of the air zones. The illustrated air cushion also includes first and second side bolsters filled with air that extend along opposite sides of the air cushion to help retain a person on the air cushion.

In the illustrated embodiment of the present invention, a mattress assembly comprises an inflatable central support portion having a head end, a foot end, a first side and a second side, and first and second side bolsters coupled to the first and second sides, respectively. The first and second side bolsters each have at least two chambers extending along a longitudinal axis of the first and second side bolsters. At least one of the chambers is a manifold in fluid communication with the central support portion. The manifold is configured to be coupled to an air supply to supply air to the central support portion and the other chambers.

Also in the illustrated embodiment, the inflatable central support and the first and second side bolsters are formed from a plurality of separately inflatable zones. The plurality of zones include a head zone, a shoulder zone, a seat zone, and a foot zone. The illustrated first and second side bolsters each include a top chamber, a central chamber, and a bottom chamber. The central chamber of the first side bolster is illustratively the manifold extending along the first side of the central support portion. The central chamber of the first side bolster is in fluid communication which each of the plurality of zones of the central support portion. The zones of the top and bottom chambers of the of the first and second side bolsters are each in fluid communication with the central support portion through a restricted flow orifice. Illustratively, the zones of the central chamber of the second side bolster are coupled to the top chambers of the second side bolster through a restricted flow orifice. Also illustratively, the bottom chambers in the shoulder zone of the of the first and second side bolsters are coupled to the central support portion by check valves which permit air flow from the central support portion into the bottom chambers in the shoulder zone.

Additional features and advantages of the invention will become apparent to those skilled in the art upon consideration of the following detailed description of an illustrated embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
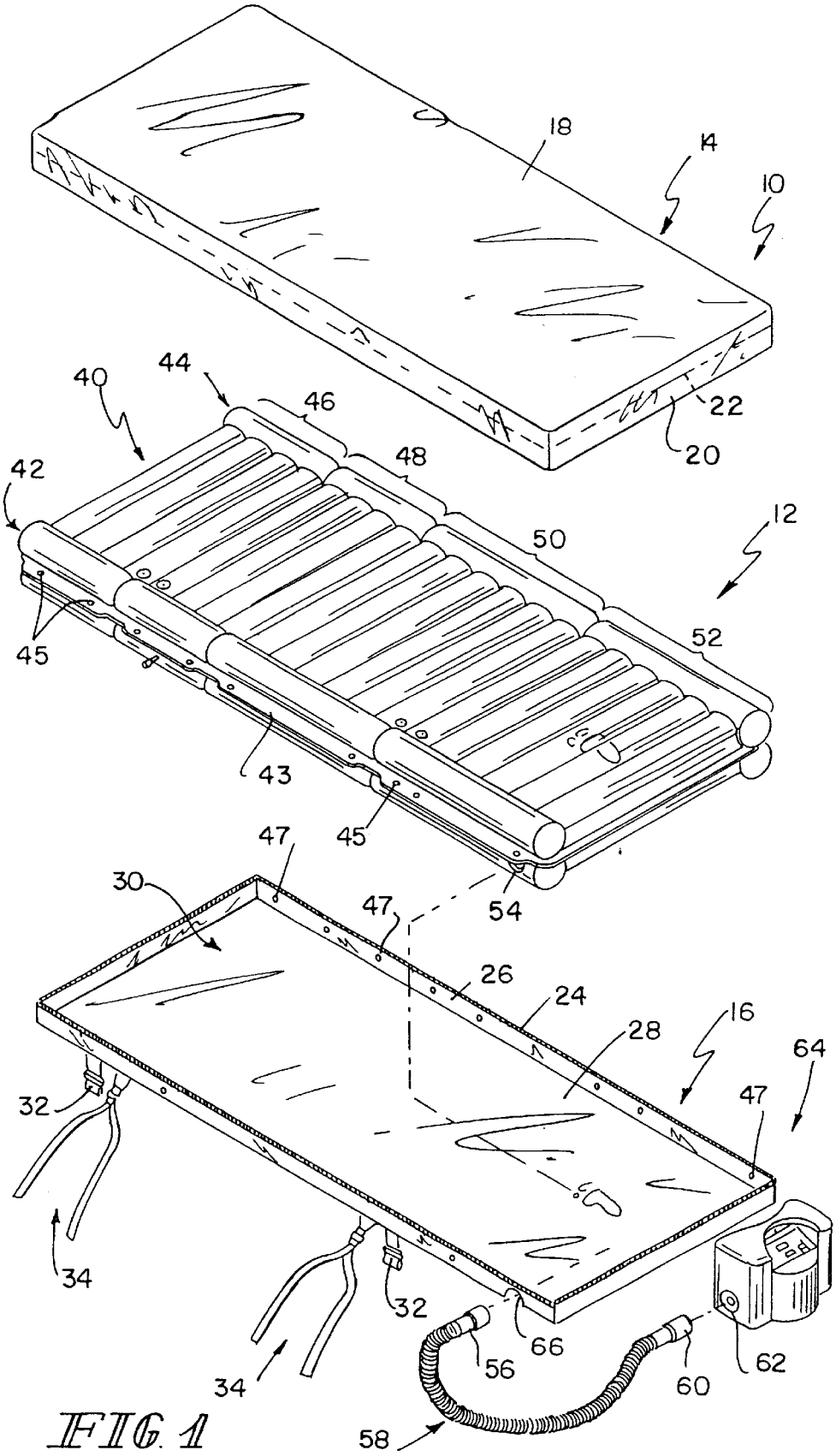
FIG. 1 is an exploded perspective view of a mattress assembly of the present invention including an air cushion having a plurality of separate air zones, top coverlet, a bottom cover, and a blower configured to be coupled to the air cushion.

Referring now to the drawings, FIG. 1 illustrates a mattress assembly 10 including an air cushion 12 configured to be located between a top coverlet 14 and a bottom cover 16. Illustratively, top coverlet 14 includes a top surface 18 and a side flap 20. A zipper 22 extends around the coverlet 14 beneath the flap 20. Zipper 22 is configured to be coupled to a zipper 24 of bottom cover 16 so that the flap 20 extends downwardly over zipper 24. Zipper 24 is coupled to a side wall 26 of cover 16 which extends upwardly from a bottom surface 28. Coverlet 14 and bottom cover 16 cooperate to define an interior region 30 for receiving the air cushion 12. Buckles 32 are coupled to opposite sides of cover 16 to secure the mattress assembly 10 to a box spring or a support deck. In addition, bottom cover 16 includes tie straps 34 which may also be used to secure the mattress assembly 10 to a support deck.

Air cushion 12 includes a side flap 43 adjacent each side bolster 42 and 44. Snaps 45 are located on each flap 43. Snaps 45 are configured to mate with snaps 47 on side wall 26 of bottom cover 16. It is understood that other suitable fasteners, such as Velcro fasteners, ties, etc. may be used instead of snaps 45 and 47.

Air cushion 12 includes a central support portion 40 which provides a sleep surface for a person resting on the mattress. Air cushion 12 also includes side bolsters 42 and 44 located on opposite sides of the central support portion 40. Air cushion 12 is illustratively divided into separate air zones including a head zone 46, a shoulder zone 48, a seat zone 50, and a foot zone 52. A hose fitting 54 is coupled to the side bolster 42 in the foot zone 52. Fitting 54 is configured to be coupled to a connector 56 on air hose 58. A connector 60 on the opposite end of hose 58 is configured to be coupled to an outlet 62 of a blower 64. Connector 56 extends through an aperture 66 formed in bottom cover 16 and into the hose fitting 54 to supply air from the blower 64 to the air cushion 12 as discussed in detail below.

Figure 6:
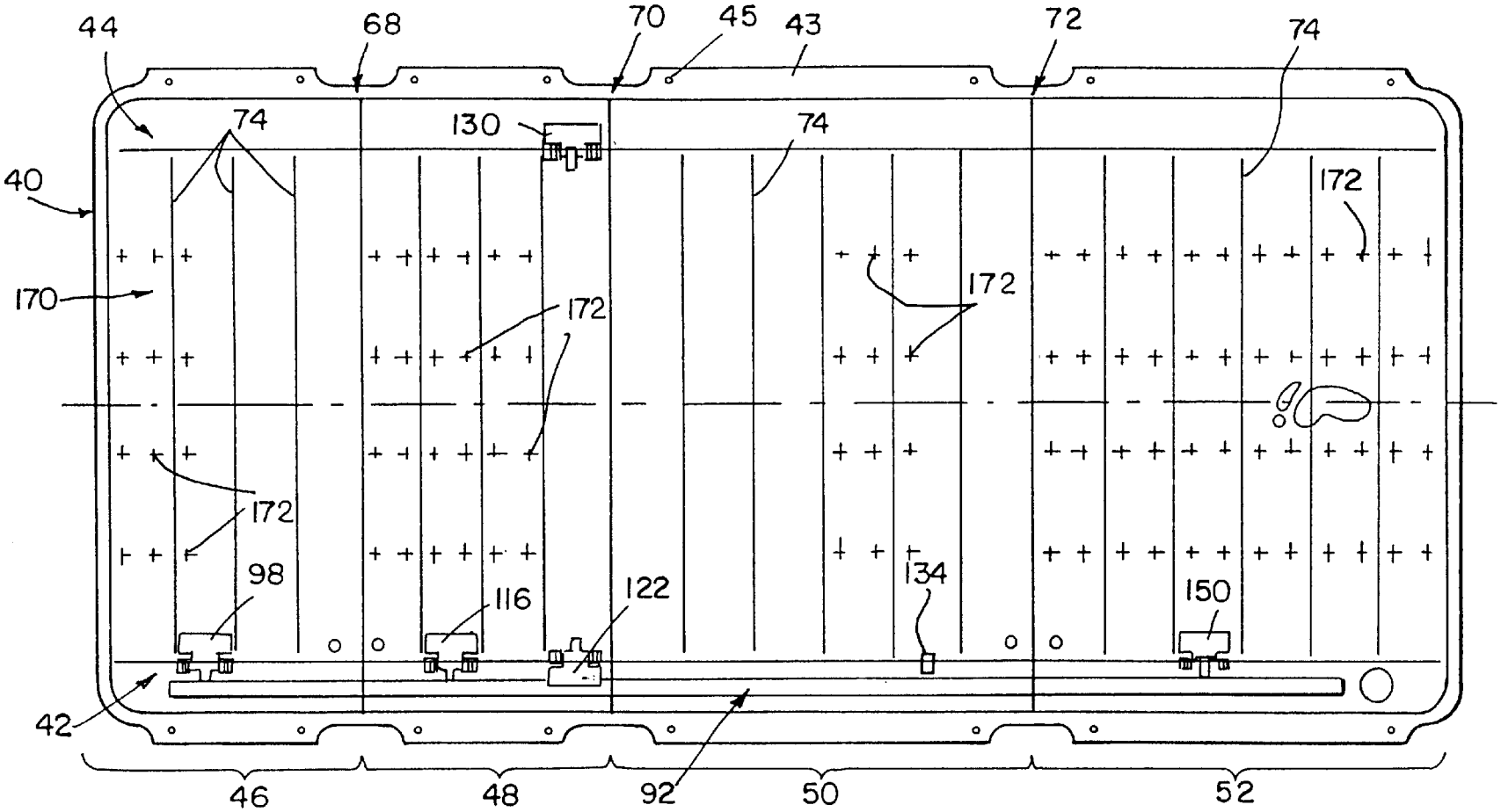
FIG. 6 is a top plan view of the air cushion of FIG. 1.

Each of the air zones 46, 48, 50, and 52 are separated by a solid divider wall 68, 70, and 72 as best illustrated in FIG. 6. The central support portion 40 further includes baffles 74 located within each zone. Baffles 74 include apertures 76 which permit air flow through the baffles 74.

First side bolster 42 includes a top chamber 80, a bottom chamber 82, and a central manifold 84. Second side bolster 44 includes a top chamber 86, a bottom chamber 88, and a central chamber 90. Top and bottom chambers 80 and 82 of side bolster 42 are divided into separate zones by dividers 68, 70, and 72 shown in FIG. 6. Manifold 84 extends continuously through the first side bolster 42 so that manifold 84 supplies air from the blower 64 to each of the separate air zones 46, 48, 50, and 52 of the air cushion 12. A split corrugated hose 92 extends through the manifold 84 to prevent opposite side walls of the manifold 84 from collapsing together to block air flow through one of the air zones.

Figure 5:
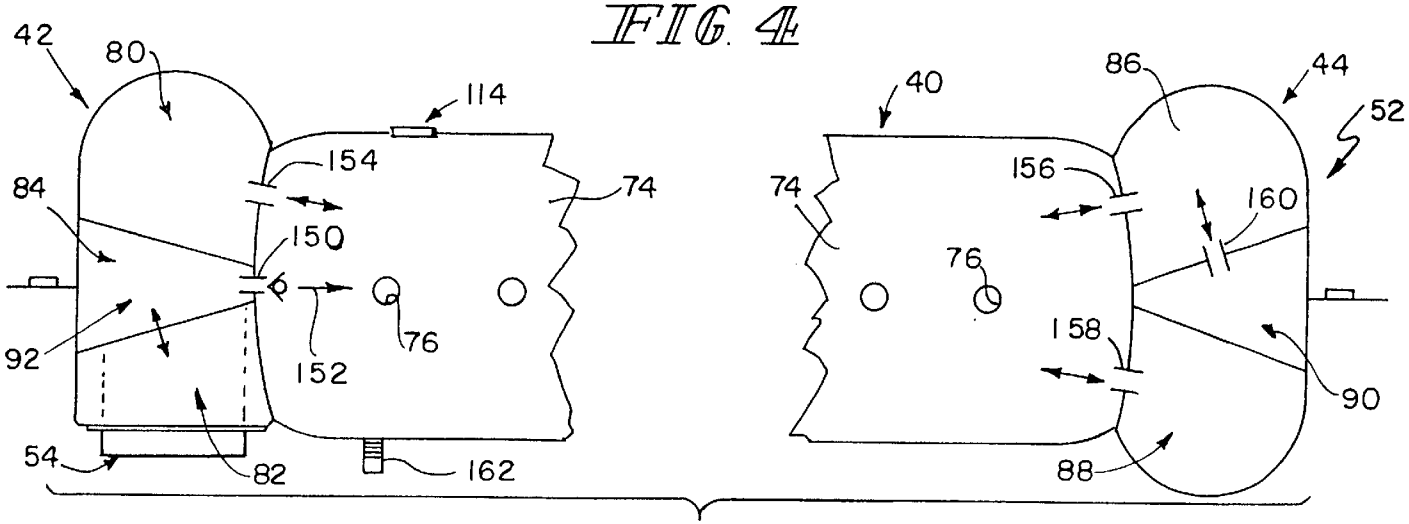
FIG. 5 is a sectional view taken through a foot zone of the air cushion.

As shown in FIG. 5, inlet air from blower 64 passes through hose 58 and hose fitting 54 into bottom chamber 82 of foot zone 52. Bottom chamber 82 is in fluid communication with manifold 84 within foot zone 52. Therefore, air flows through the manifold 84 along the entire side bolster 42.

Figure 2:
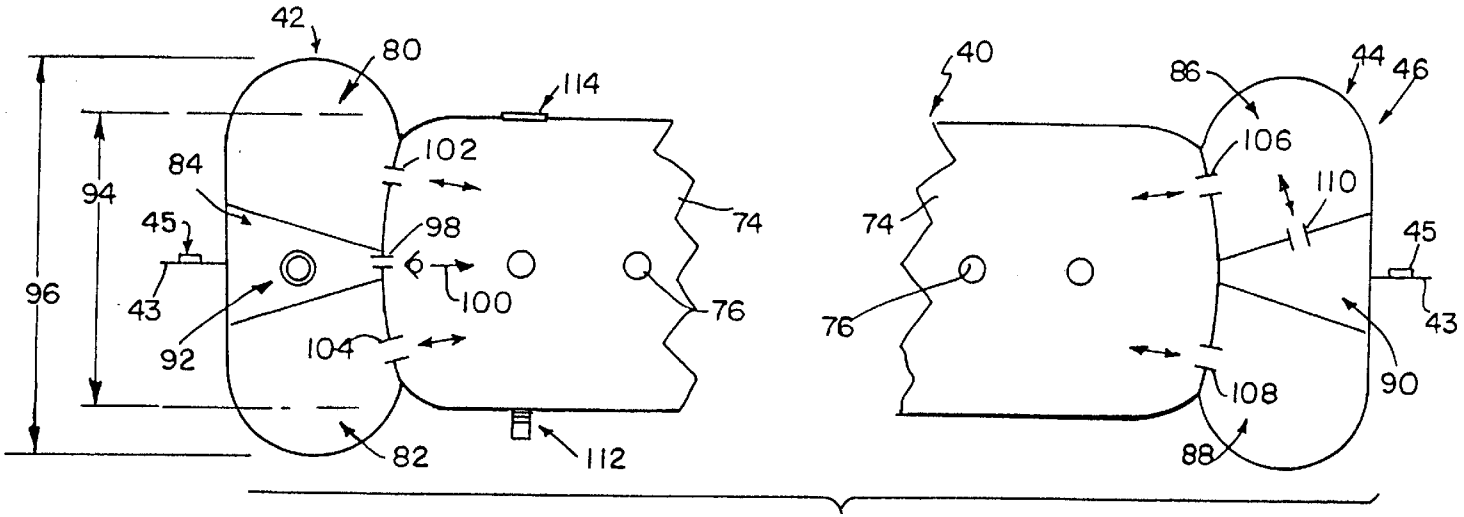
FIG. 2 is a sectional view taken through a head zone of the air cushion.

Referring now to FIG. 2, the configuration of the head zone 46 of the air cushion 12 is illustrated. The central support portion 40 has a thickness illustrated by dimension 94. Side bolsters 42 and 44 have a thickness illustrated by dimension 96 which is greater than the thickness of the support portion 40. The increased thickness of side bolsters 42 and 44 helps to maintain a person on the air cushion 12. The top and bottom chambers of the side bolsters 42, 44 simulate a rectangular shape and provide an increased sleep surface area compared to a single round side bolster chamber.

In head zone 46, air from manifold 84 passes into central support portion 40 through a check valve 98 in the direction of arrow 100 to supply the central support portion 40 with air from the blower 64. Air from central support portion 40 passes through a restricted flow orifice 102 into top chamber 80 and through a restricted flow orifice 104 into bottom chamber 82 of side bolster 42. In addition, air from central portion 40 passes through a restricted flow orifice 106 into top chamber 86 of side bolster 44 and through restricted flow orifice 108 into bottom chamber 88 of side bolster 44. Air also passes from top chamber 86 to central chamber 90 of side bolster 44 through a restricted flow orifice 110. Illustratively, orifices 102, 104, 106, 108, and 110 all have a size of 1/8 inch. A dump valve 112 is coupled to central portion 40 to permit the head zone 46 to be deflated quickly. A test port 114 is also coupled to central support portion 40. Test port 114 is configured to receive a needle to check the pressure within zone 46.

Figure 3:
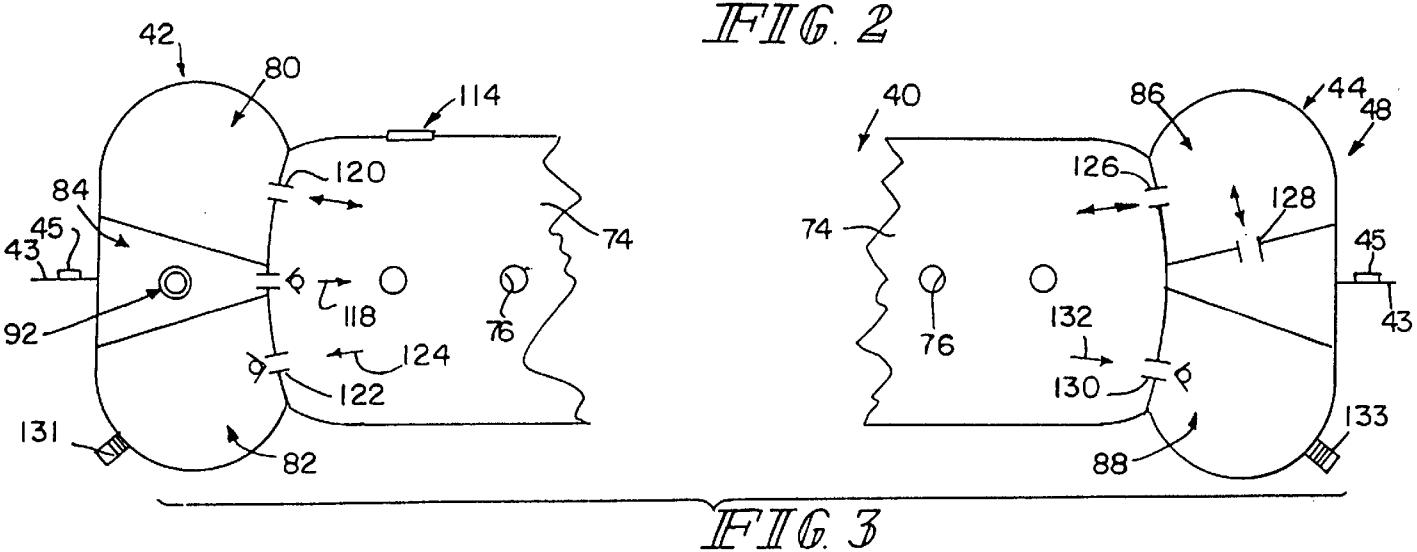
FIG. 3 is a sectional view taken through a shoulder zone of the air cushion.

FIG. 3 illustrates the configuration of the air cushion 12 in the shoulder zone 48. Air from the manifold 84 passes through a check valve 116 into central support portion 40 in the direction of arrow 118. Air from central support portion 40 flows into top chamber 80 of side bolster 42 through an orifice 120. Air from central support portion 40 also passes through a check valve 122 into bottom chamber 82 of side bolster 42 in the direction of arrow 124. In addition, air from central support portion 40 passes into top chamber 86 of side bolster 44 through a restricted flow orifice 126. Air from chamber 86 passes into central chamber 90 through orifice 128. Air also passes from central support portion 40 through a check valve 130 into bottom chamber 88 of side bolster 44 in the direction of arrow 132. Illustratively, orifices 120, 126, and 128 have a dimension of ⅛ inch. Dump valves 131 and 133 are coupled to bottom chambers 82 and 88, respectively, of shoulder zone 48.

Check valves 122 and 130 permit air to enter bottom chambers 82 and 88, respectively. However, air cannot pass back through check valves 122 and 130 into the central support portion 40. Therefore, these bottom chambers 82 and 88 within shoulder zone 48 remain at relatively high pressure to provide additional support in bolsters 42 and 44 within the shoulder zone. As the weight of the patient increases, the pressure within bottom chambers 82 and 84 within shoulder zone 48 also increases.

Figure 4:
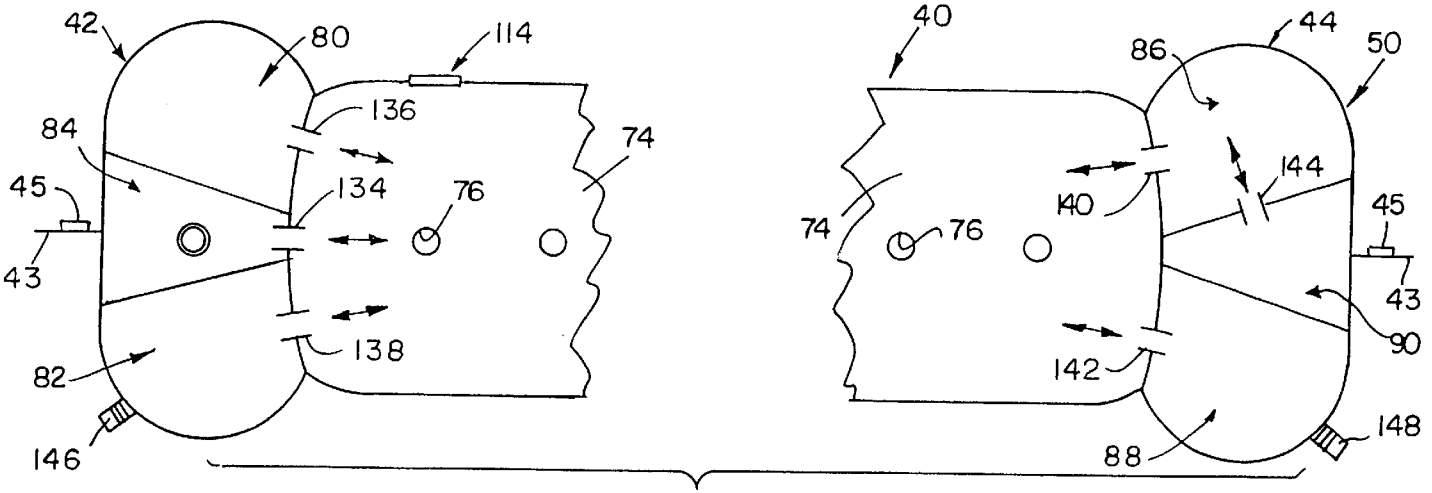
FIG. 4 is a sectional view taken through a seat zone of the air cushion.

FIG. 4 illustrates the configuration of the air cushion 12 within the seat zone 50. Air manifold 84 is coupled to central support portion 40 by an orifice 134. Illustratively, orifice 134 has a dimension of ⅜ inch. Therefore, the pressure within central support portion 40 of seat zone 50 is maintained at substantially the air manifold pressure. Air passes from central support portion 40 into top chamber 80 and bottom chamber 82 of side bolster 42 through restricted flow orifices 136 and 138, respectively. Air also passes from central support portion 40 into top chamber 86 and bottom chamber 88 of side bolster 44 through restricted flow orifices 140 and 142, respectively. Air passes from top chamber 86 to central chamber 90 of sidle bolster 44 through a restrictive flow orifice 144. Illustratively, orifices 136, 138, 140, 142, and 144 each have a dimension of ⅛ inch. Dump valves 146 and 148 are coupled to bottom chambers 82 and 88, respectively. A test port 114 is coupled to central support portion 40.

A configuration of foot zone 52 of air cushion 12 is illustrated in FIG. 5. Air manifold 84 is coupled to central support portion 40 of foot zone 52 by a check valve 150 so that air flows from manifold 84 into central support portion 40 in the direction of arrow 152. Air passes from central support portion 40 into top chamber 80 of side bolster 42 through restricted flow orifice 154. Air also passes into top chamber 86 and the bottom chamber 88 of side bolster 44 through restrictive flow orifices 156 and 158, respectively. Air flows from top chamber 86 to central chamber 90 of side bolster 44 through restricted flow orifice 160. Illustratively, orifices 154, 156, 158, and 160 have a dimension of 1/8 inch. A dump valve 162 is coupled to central support portion 40 within foot zone 52. A test port 114 is also coupled to central support portion 40 within foot zone 52.

Figure 7:
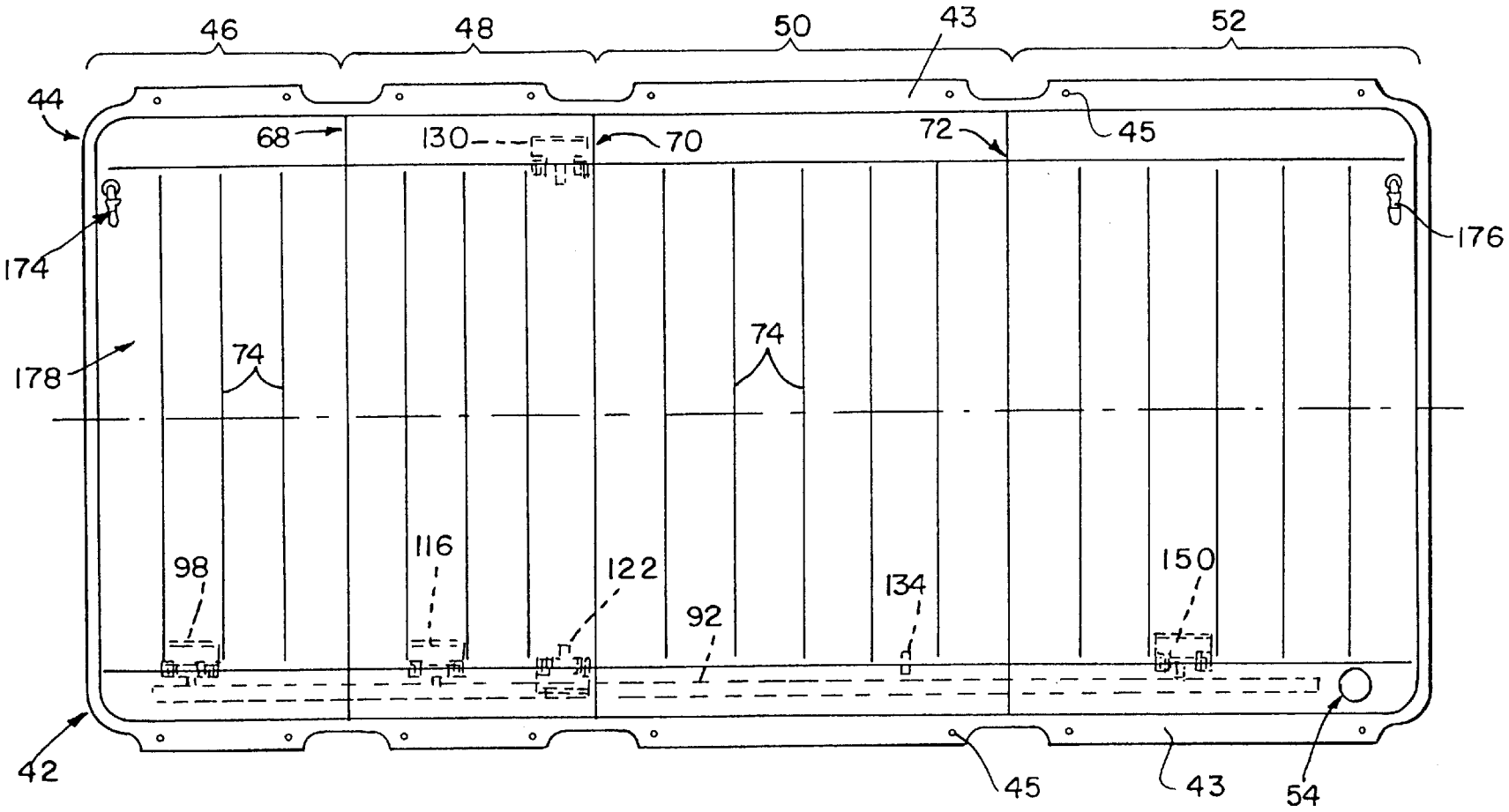
FIG. 7 is a bottom plan view of the air cushion.

Air pressure within each of the air zones 46, 48, 50, and 52 is controlled by the number of micro holes 172 formed in a top surface 170 of each zone of the central support portion 40. Illustratively, head zone 46 includes 12–16 micro holes 172, shoulder zone 48 includes 20–24 micro holes, seat zone 50 includes 12 micro holes, and foot zone 52 includes 36–48 micro holes. The number of micro holes 172 in each zone 46, 48, 50, and 52 controls the pressure within the zone since the same manifold pressure from air manifold 84 is supplied to each zone. Therefore, pressure within the zones 46, 48, 50, and 52 can be established at a desired level by altering the size or number of micro holes 172 formed in top surface 170 of central support surface 40. In another embodiment, a separate orifice is coupled to the central support portion 40 in each zone to adjust the air flow out of the zone without micro holes being formed in the top surface 170. As shown in FIG. 7, bleeder valves 174, 176 are coupled to a bottom surface 178 of air cushion 12 in communication with the head zone 46 and foot zone 52. Bleeder valves 174, 176 further reduce the pressure in head zone 46 and foot zone 52. When bleeder valves 174, 176 are used, micro holes 172 are not used to vent head zone 46 and foot zone 52.

The side bolsters 42 and 44 help retain a person on the central support portion 40 as the person moves toward an edge of the mattress. Since air flow out of the side bolsters 42, 44 is restricted, air cannot rush to an opposite side of the air cushion 12 as the person moves toward a side of the air cushion 12. The number of micro holes 172 is illustratively selected so that the seat zone 50 has the highest pressure. Shoulder zone 48 illustratively has the next highest pressure. Head zone 46 and foot zone 52 have the lowest pressures.

The mattress assembly 10 of the present invention may be used as a mattress overlay or as a mattress replacement. Typically, the thickness of the mattress overlay is less than the thickness for a mattress replacement air cushion. If desired, such as in a mattress replacement situation, the orifices 138 and 142 of seat zone 50 may be replaced with check valves such as illustrated by check valves 122 and 130 in FIG. 3 so that air is forced into bottom chambers 82 and 88 based on the weight of the patient. If such check valves are used, air cannot return from bottom chambers 82 and 88 of the seat zone 50 to the central portion 40 as discussed with regard to FIG. 3. Therefore, this embodiment would provide additional stiffness for the side bolsters 42,44.

Figure 8:
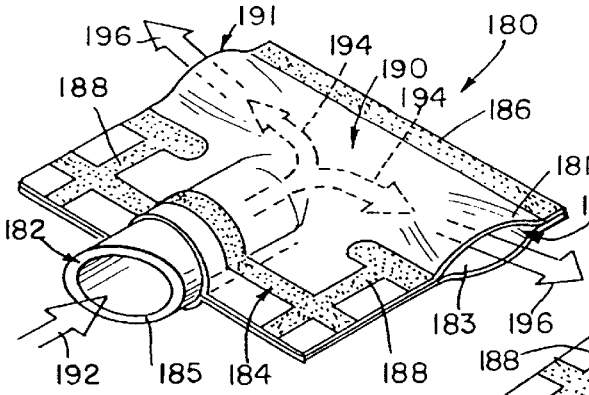
FIG. 8 is a perspective view of a check valve of the present invention in an open orientation to permit air flow from a manifold into a central support portion of the air cushion.
Figure 9:
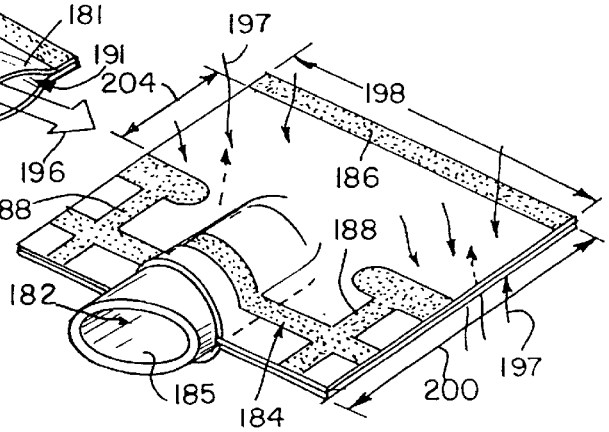
FIG. 9 is a perspective view of the check valve of FIG. 8 illustrating the check valve in a closed position.

FIGS. 8 and 9 illustrate a check valve 180 of the present invention. Check valve 180 is illustratively formed from two sheets 181, 183 of high temperature urethane material having a thickness of about 0.008 inch. The thickness may be less if desired. The sheets are seam sealed to an air zone surface around a tube 182 by seams 184. Tube 182 includes an angle cut end 185 to reduce the likelihood that the tube 182 will be sealed by a portion of manifold 84. Seals such as RF welds are also provided at locations 186 and 188 to provide a generally T-shaped open region 190 between the sheets 181, 183 of the valve 180. Open region 190 has openings 191 which are not sealed by seams. Air can flow through the tube 182 in the direction of arrow 192. Air the passes into region 190 as illustrated by arrows 194 in FIG. 8 and exits the valve 180 through openings 191 as illustrated by arrows 196. The sheets 181, 183 of valve 180 collapse and block air flow through the region 190 in the direction of arrows 197 to provide a check valve as shown in FIG. 9. Dimension 198 of valve 180 is illustratively 3.250 inches. Dimension 200 of valve 180 is illustratively 2.375 inches. Dimension 204 of valve 180 is illustratively 1.000 inch.

Figure 10:
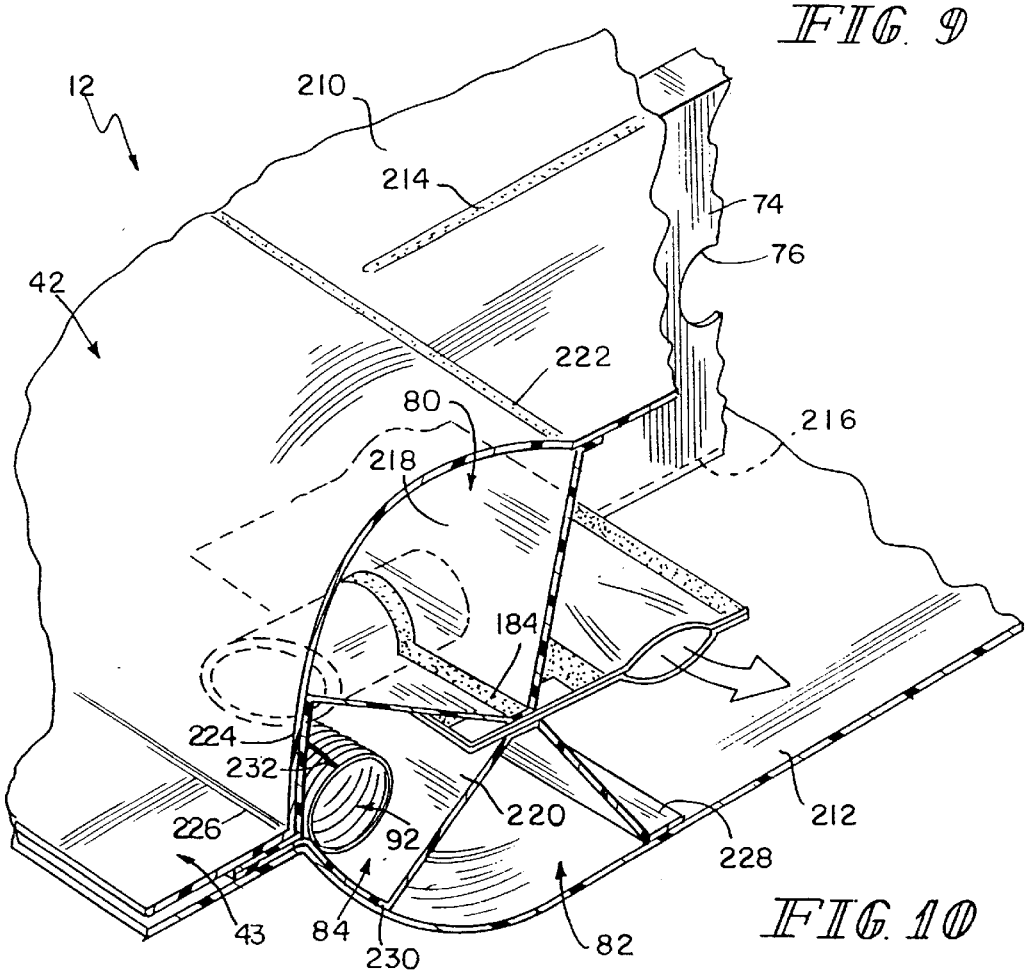
FIG. 10 is a perspective view of a portion of the air cushion illustrating a plurality of chambers within a side bolster located adjacent to a support zone of the air cushion.

Additional details of the air cushion 12 are illustrated in FIG. 10. Air cushion 12 includes a top sheet of material 210 and a bottom sheet of material 212 which extend across the entire width of the air cushion 12. Baffles 74 are coupled to top sheet 210 and bottom sheet 212 by seams 214 and 216, respectively. Air cushions 212 further include upper and lower interior sheets of material 218 and 220 which form the side bolsters 42 and 44. Only one side bolster 42 is illustrated in FIG. 10.

Upper sheet 218 is coupled to top sheet 210 by seam 222. Sheet 218 is also coupled to top sheet 210 at a spaced-apart location 224 to define the top chamber 80 of bolster 42. Sheets 210, 212, 218, and 220 are all coupled together by seam 222 adjacent flap 43. Lower sheet 220 is coupled to bottom sheet 212 by seam 228. Lower sheet 220 is also coupled to upper sheet 218 by seam 184. Illustratively, the check valve 180 is coupled to the top and bottom sheets 218 and 220 as shown in FIG. 10.

Lower sheet 220 is also coupled to bottom sheet 212 at a location 230 spaced apart from seam 228 to define bottom chamber 82 of bolster 42. Manifold 84 is formed between upper and lower sheets 218 and 220 between seams 184, 224, 226, and 230.

Hose 92 extends through manifold 84 as shown in FIG. 10 to prevent the sheets 218 and 220 which form manifold 84 from collapsing against each other to seal the manifold 84. Tube 92 is split along its length as shown by split 232. Therefore, air can flow through the tube 92 and through the split portion 232. In other words, tube 92 provides structural support within the manifold 84 to hold the manifold 84 open. It is understood that other structural support members such as springs, etc. which permit air flow through the support member may be used in accordance with the present invention.

Although the invention has been described in detail with reference to certain illustrated embodiments, variations and modifications exist within the scope and spirit of the invention as defined by the following claims.

What is claimed is:

1. A mattress assembly comprising an inflatable central support portion having a head end, a foot end, a first side and a second side, and first and second side bolsters coupled to the first and second sides, respectively, of the inflatable central support portion, the first and second side bolsters each having at least two chambers extending along a longitudinal axis of the first and second side bolsters, at least one of the chambers being a manifold in fluid communication with the central support portion, the manifold being configured to be coupled to an air supply to supply air to the central support portion and the other chambers.

2. The mattress assembly of claim 1, further comprising at least one check valve coupled between the manifold and the central support portion to permit air flow from the manifold into the central support portion.

3. The mattress assembly of claim 2, wherein the least one check valve includes a top sheet, a bottom sheet, and a tube, the top and bottom sheets being sealed around the tube to provide an air inlet located within the manifold, and the top and bottom sheets cooperating to define at least one air opening located within the central support portion.

4. The mattress assembly of claim 3, wherein the top and bottom sheets cooperate to define two air openings located within the central support portion.

5. The mattress assembly of claim 3, wherein the tube has an angled end surface.

6. The mattress assembly of claim 1, further comprising a support member extending through the manifold.

7. The mattress assembly of claim 6, wherein the support member is a split hose.

8. The mattress assembly of claim 1, wherein first and second side bolsters each include a top chamber, a central chamber, and a bottom chamber.

9. The mattress assembly of claim 8, wherein the central chamber of the first side bolster is the manifold.

10. The mattress assembly of claim 1, wherein the inflatable central support and the first and second side bolsters are formed from a plurality of separately inflatable zones.

11. The mattress assembly of claim 10, wherein the plurality of zones include a head zone, a shoulder zone, a seat zone, and a foot zone.

12. The mattress assembly of claim 11, wherein a plurality of micro-holes are formed in a top surface of at least one of the head zone, the shoulder zone, the seat zone, and the foot zone.

13. The mattress assembly of claim 10, wherein first and second side bolsters each include a top chamber, a central chamber, and a bottom chamber, the central chamber of the first side bolster being the manifold extending along the first side of the central support portion, the central chamber of the first side bolster being in fluid communication which each of the plurality of zones of the central support portion, the zones of the top and bottom chambers of the of the first and second side bolsters being in fluid communication with the central support portion through a restricted flow orifice.

14. The mattress assembly of claim 13, wherein the zones of the central chamber of the second side bolster are coupled to the top chambers of the second side bolster through a restricted flow orifice.

15. The mattress assembly of claim 13, wherein the bottom chambers in a shoulder zone of the of the first and second side bolsters are coupled to the central support portion by check valves which permit air flow from the central support portion into the bottom chambers in the shoulder zone.

16. The mattress assembly of claim 1, further comprising a bottom cover located underneath the inflatable central support and the first and second side bolsters, and a top coverlet located above the inflatable central support and the first and second side bolsters.

17. The mattress assembly of claim 1, further comprising a plurality of baffles located within an interior region of the central support portion, the baffles being formed to include at least one aperture to permit air flow through the baffles.

* * * * *